US010336510B2

(12) United States Patent
El-Saden et al.

(10) Patent No.: US 10,336,510 B2
(45) **Date of Patent: *Jul. 2, 2019**

(54) DRINK BOTTLE WITH CONTROLLED OPENING

(71) Applicant: IGNITE USA, LLC, Chicago, IL (US)

(72) Inventors: Sami El-Saden, Winnetka, IL (US); Daniel M. Wodka, Chicago, IL (US); Robert C. Coon, Chicago, IL (US); Paul D. Hurley, Libertyville, IL (US)

(73) Assignee: IGNITE USA, LLC, Chicago, IL (US)

( * ) Notice: Subject to any disclaimer, the term of this patent is extended or adjusted under 35 U.S.C. 154(b) by 2 days.

This patent is subject to a terminal disclaimer.

(21) Appl. No.: 15/651,747

(22) Filed: Jul. 17, 2017

(65) Prior Publication Data

US 2017/0313478 A1 Nov. 2, 2017

Related U.S. Application Data

(63) Continuation of application No. 14/046,400, filed on Oct. 4, 2013, now Pat. No. 9,708,107, which is a (Continued)

(51) Int. Cl.
*A45F 3/16* (2006.01)
*A45F 3/18* (2006.01)
(Continued)

(52) U.S. Cl.
CPC ..... *B65D 47/065* (2013.01); *A45F 3/16* (2013.01); *A45F 3/18* (2013.01); *A47G 19/2266* (2013.01)

(58) Field of Classification Search
CPC ..... A47G 19/2272; A47G 19/2266; B65D 47/065; B65D 47/2037
See application file for complete search history.

(56) References Cited

U.S. PATENT DOCUMENTS 2,844,267 A 7/1958 Petriccione
2,893,612 A 7/1959 Akers
(Continued)

FOREIGN PATENT DOCUMENTS

CN 201754915 U 3/2011
DE 102013010431 A1 12/2014
WO WO-2010/085367 A1 7/2010

OTHER PUBLICATIONS

International Preliminary Report on Patentability, International Application No. PCT/US2012/022769, dated Jul. 30, 2013.
(Continued)

*Primary Examiner* — Jeffrey R Allen
(74) *Attorney, Agent, or Firm* — Marshall, Gerstein & Borun LLP

(57) ABSTRACT

A drink bottle may include a container, a lid connected to the container and including a lid housing, a spout coupled to the lid housing, and an actuator assembly movably connected to the lid housing. The spout is movable between a stowed configuration and a dispensing configuration, the spout defining a passageway in fluid communication with an interior of the container when disposed in the dispensing configuration. The actuator assembly is operatively coupled to the spout when the spout is disposed in the stowed configuration to retain the spout in the stowed configuration, and the spout moves from the stowed configuration to the dispensing configuration responsive to actuation of the actuator assembly.

19 Claims, 6 Drawing Sheets

Related U.S. Application Data continuation-in-part of application No. 13/359,178, filed on Jan. 26, 2012, now Pat. No. 8,602,238.

(60) Provisional application No. 61/436,474, filed on Jan. 26, 2011.

(51) Int. Cl.
*B65D 47/06* (2006.01)
*A47G 19/22* (2006.01)

(56) References Cited

U.S. PATENT DOCUMENTS

| | | | |
|---|---|---|---|
| 2,936,934 | A | 5/1960 | Kubiliunas |
| 3,283,967 | A | 11/1966 | Akers |
| 3,881,643 | A | 5/1975 | LaVange |
| 4,782,964 | A | 11/1988 | Poore et al. |
| 4,804,113 | A | 2/1989 | Ciaccio |
| 4,940,167 | A | 7/1990 | Fillmore et al. |
| 5,137,168 | A | 8/1992 | Mothrath et al. |
| 5,203,468 | A | 4/1993 | Hsu |
| 5,273,172 | A | 12/1993 | Rossbach et al. |
| 5,332,131 | A | 7/1994 | Pehr |
| 5,339,982 | A | 8/1994 | Tardie |
| 5,346,081 | A | 9/1994 | Lin |
| 5,361,934 | A | 11/1994 | Spence, Jr. |
| 5,409,131 | A | 4/1995 | Phillips et al. |
| 5,427,271 | A | 6/1995 | Wang |
| 5,465,866 | A | 11/1995 | Belcastro |
| 5,484,080 | A | 1/1996 | Blasnik et al. |
| 5,582,316 | A | 12/1996 | Masayoshi et al. |
| 5,819,972 | A | 10/1998 | Puente Pubill |
| 5,873,478 | A | 2/1999 | Sullivan et al. |
| 5,884,793 | A | 3/1999 | Wang |
| 5,897,013 | A | 4/1999 | Manganiello |
| 5,908,126 | A | 6/1999 | Wang |
| 6,116,458 | A | 9/2000 | Dark |
| 6,196,413 | B1 | 3/2001 | Tung |
| 6,276,560 | B1 | 8/2001 | Belcastro |
| 6,279,773 | B1 | 8/2001 | Kiyota |
| 6,390,341 | B1 | 5/2002 | Ohmi et al. |
| 6,523,711 | B1 | 2/2003 | Hughes et al. |
| 6,609,624 | B2 | 8/2003 | Goto et al. |
| 6,991,126 | B2 | 1/2006 | Jackel |
| 7,059,490 | B2 | 6/2006 | Son |
| 7,124,907 | B2 | 10/2006 | Conaway |
| D533,061 | S | 12/2006 | Li |
| D547,607 | S | 7/2007 | Forsman |
| 7,255,241 | B2 | 8/2007 | Yoneoka et al. |
| 7,516,862 | B2 | 4/2009 | McDonough |
| D592,913 | S | 5/2009 | Pinelli et al. |
| 7,533,783 | B2 | 5/2009 | Choi et al. |
| 7,708,035 | B2 | 5/2010 | Windmiller |
| 7,766,057 | B2 | 8/2010 | Windmiller |
| D626,838 | S | 11/2010 | Meyers et al. |
| D634,161 | S | 3/2011 | Roth et al. |
| 8,191,727 | B2 | 6/2012 | Davies et al. |
| 8,469,226 | B2 | 6/2013 | Davies et al. |
| 8,602,238 | B2 | 12/2013 | El-Saden et al. |
| 9,120,604 | B2 | 9/2015 | Lohn |
| 9,162,802 | B2 | 10/2015 | El-Saden et al. |
| 9,708,107 | B2 | 7/2017 | El-Saden et al. |
| 2002/0036207 | A1* | 3/2002 | Ohuo ..... A47G 19/2266 220/830 |
| 2002/0040909 | A1 | 4/2002 | Goto et al. |
| 2003/0085232 | A1 | 5/2003 | Leinenweber |
| 2003/0102318 | A1 | 6/2003 | Lee |
| 2004/0069783 | A1 | 4/2004 | Chen |
| 2005/0133519 | A1 | 6/2005 | McDonough |
| 2006/0043091 | A1 | 3/2006 | Pinelli et al. |
| 2006/0226110 | A1* | 10/2006 | Choi ..... A47G 19/2266 215/228 |
| 2007/0039959 | A1 | 2/2007 | Choi et al. |
| 2008/0036207 | A1 | 2/2008 | Choi |
| 2008/0237233 | A1 | 10/2008 | Choi et al. |
| 2008/0272122 | A1 | 11/2008 | Son |
| 2008/0272134 | A1 | 11/2008 | Rohe |
| 2010/0170902 | A1 | 7/2010 | Britto et al. |
| 2010/0181329 | A1 | 7/2010 | Davies et al. |
| 2011/0198361 | A1 | 8/2011 | Chen |
| 2012/0187075 | A1 | 7/2012 | El-Saden et al. |

OTHER PUBLICATIONS

Patent Cooperation Treaty, "International Search Report and the Written Opinion of the International Searching Authority," issued in connection with International Patent Application No. PCT/US2012/022769, dated May 11, 2012, 7 pages.

Photos of beverage container obtained from Starbucks coffee, on or about Nov. 2011.

Extended European Search Report, European patent application No. 14850984.7, dated Mar. 6, 2017.

Search Report, Chinese Patent Application No. 201480058783, dated Mar. 20, 2017.

First Office Action (with English translation), Chinese Patent Application No. 201480058783, dated Apr. 5, 2017.

* cited by examiner

DRINK BOTTLE WITH CONTROLLED OPENING

RELATED APPLICATIONS

This application is a continuation of U.S. application Ser. No. 14/046,400 filed Oct. 4, 2013 which is a continuation-in-part of U.S. application Ser. No. 13/359,178, filed Jan. 26, 2012, which claims the priority benefit of U.S. Provisional Patent Application No. 61/436,474, filed Jan. 26, 2011, all of which are expressly incorporated herein by reference and made a part hereof.

FIELD OF THE DISCLOSURE

The present disclosure relates generally to drink bottles, and more particularly, to drink bottles with a spout protected in a cocoon in a stowed configuration and a freely movable spout in a dispensing configuration.

BACKGROUND

Many conventional drink bottles fail to protect the spout from damage and/or contamination when in a stowed or non-use configuration. Additionally, conventional drink bottles may also have complex valve or covering mechanisms necessary to manipulate in order to dispense the fluid in the container. Improvements have been made, however, additional disadvantages have been discovered. Notably, drink bottles that use or incorporate a biasing mechanism to facilitate movement of the spout from a non-use configuration to a use configuration discharge or fling liquid that remained in the spout after the last use. Unfortunately, the discharge is often flung onto the face or body of the user, which is a less than pleasing experience. Accordingly, there is a need in the art for a drink bottle that overcomes the disadvantages of the prior art.

BRIEF DESCRIPTION OF THE DRAWINGS

The following disclosure as a whole may be best understood by reference to the provided detailed description when read in conjunction with the accompanying drawings, drawing description, abstract, background, field of the disclosure, and associated headings. Identical reference numerals when found on different figures identify the same elements or a functionally equivalent element. The elements listed in the abstract are not referenced but nevertheless refer by association to the elements of the detailed description and associated disclosure.

DETAILED DESCRIPTION OF THE PREFERRED EMBODIMENTS

Figure 1:
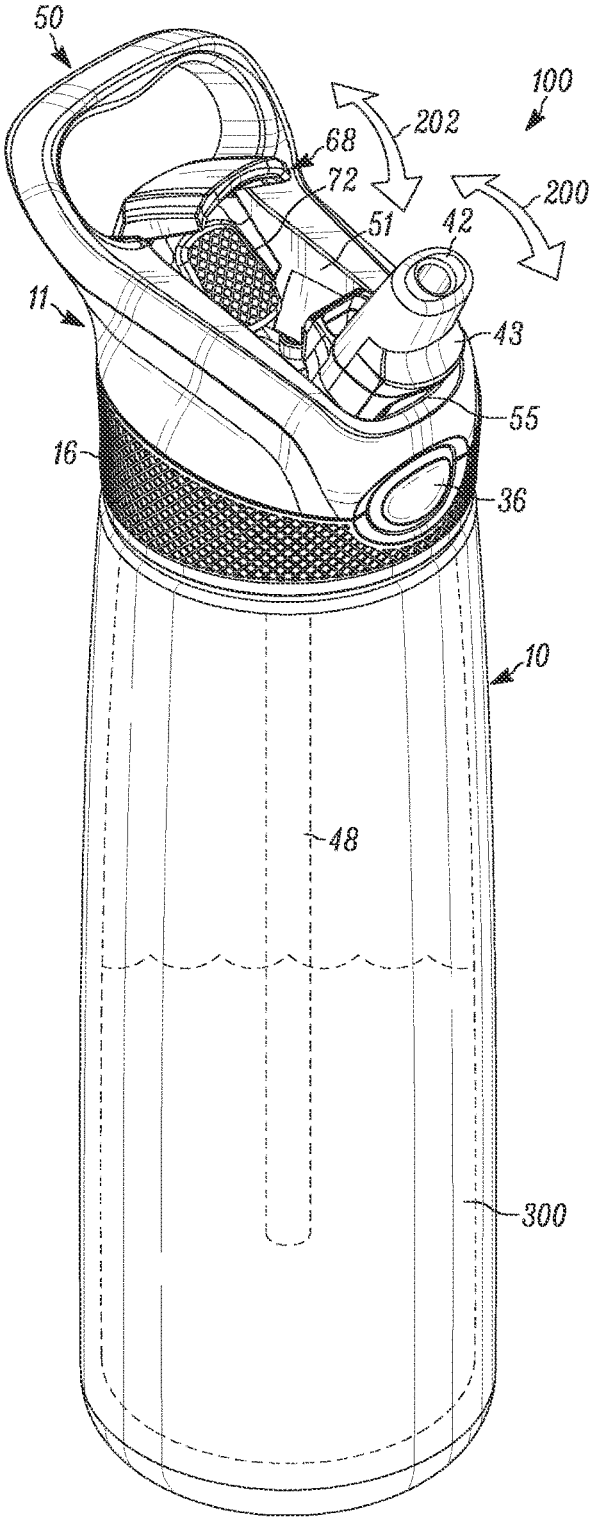
FIG. 1 is a perspective view of a drink bottle in accordance with one embodiment of the present disclosure.

The present disclosure is not limited to the particular details of the apparatus depicted, and other modifications and applications may be contemplated. Further changes may be made in the apparatus, device or methods without departing from the true spirit of the scope of the disclosure herein involved. It is intended, therefore, that the subject matter in this disclosure should be interpreted as illustrative, not in a limiting sense.

In one aspect of the present disclosure, a drink bottle may include a container and a lid connected to the container. The lid may include an open-top channel defined in the lid by an interior sidewall, and a spout and a spout cover disposed within the channel. Each of the spout and the spout cover may be moved in opposite directions between a stowed configuration and a dispensing configuration. The spout may include a projection that engages the sidewall to control a rate of movement of the spout.

In another aspect of the present disclosure, the spout and spout cover may be connected to the lid at diametrically opposed positions.

In yet another aspect of the present disclosure, an actuator assembly may be operatively coupled to the spout to facilitate movement of the spout between the stowed and dispensing configurations. The actuator assembly may include a latch assembly selectively connected to the spout, a user input feature or other suitable device, apparatus, or the like, etc.

In a further aspect of the present disclosure, the spout cover may be normally biased to the dispensing configuration. For example, a counterweight may be connected to an outer portion of the spout cover to orient a center of gravity of the spout cover offset from an axle of the spout cover or a spring element may include a first end contiguous with the spout cover and a second end contiguous with the lid.

In still yet another aspect of the present disclosure, the spout initiates movement of the spout cover from the stowed configuration in one embodiment and from the dispensing configuration in another or the same embodiment.

In another aspect of the present disclosure, a collar may be connected about the spout such that the projection extends through an opening in the collar or is disposed above the collar.

In yet another aspect of the present disclosure, the spout rate of movement is less than a rate of movement of the spout cover when each is moved between the stowed and dispensing configurations.

In still yet another aspect of the present disclosure, the projection extends normal to a plane of rotation defined by a longitudinal axis of the spout when moved between the stowed and dispensing configurations. Moreover, the projection may be configured as an arm extending laterally with respect to a longitudinal axis of the spout.

In a further aspect of the present disclosure, a biasing element may be disposed to impart a force on the spout to the dispensing configuration, provided, however, that the projection engagement with the sidewall dissipates the biasing force. In one embodiment, the force is dissipated such that the spout does not contact an end portion of the sidewall.

Figure 6:
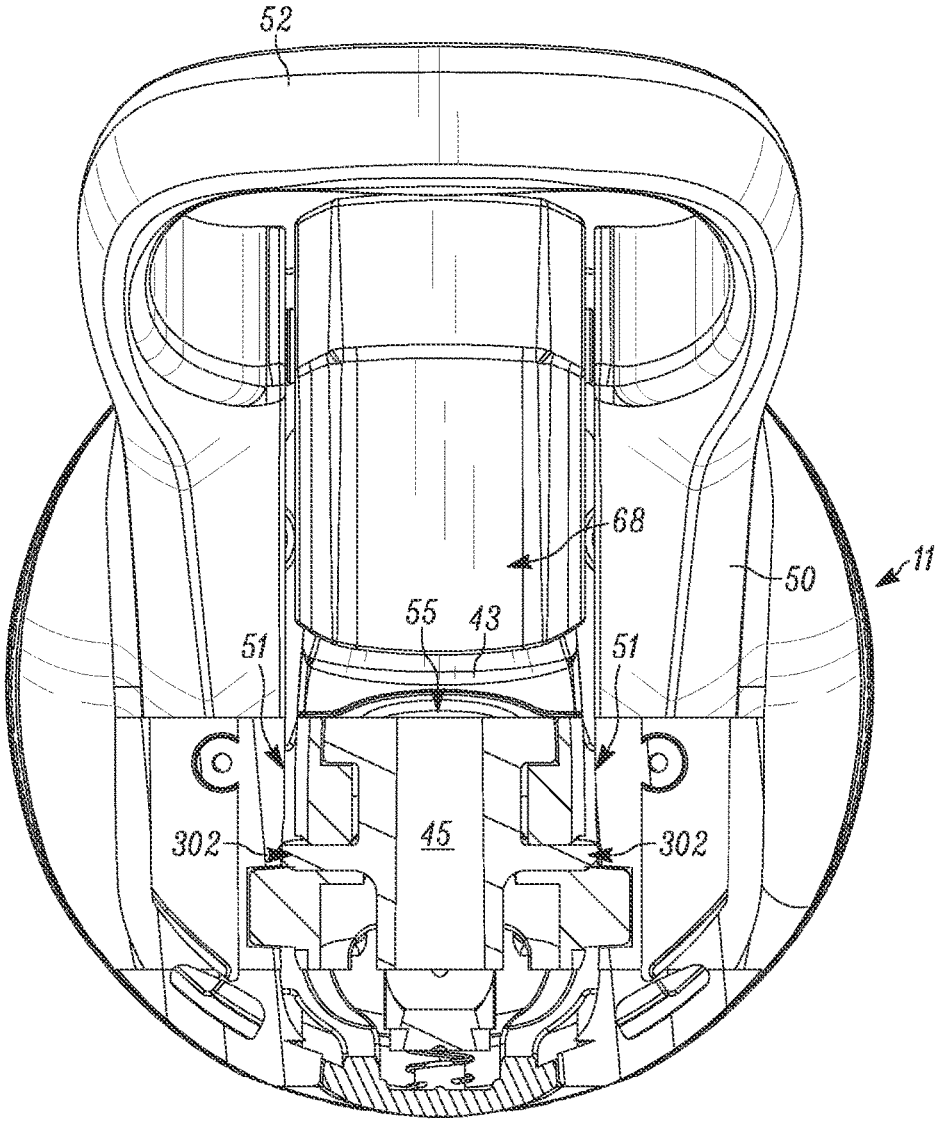
FIG. 6 is a cross-sectional view of the lid of the drink bottle of FIG. 1 in a stowed configuration.

FIG. 1 is an elevation view that illustrates a drink bottle 100 in accordance with one embodiment of the present disclosure that may include, in one embodiment, a container 10 and a lid 11 connected to the container 10. It will be recognized by those of skill in the art that each such component may be formed by single or multiple elements, separately or integrally formed. For example, the lid 11 may include a thread skirt 16, housing 50, an actuator 36 operatively associated with a spout 42, such as by direct, selective, removable, intermittent, or the like, etc. connection to the spout 42, and a spout cover 68, in one embodiment. In one embodiment, the spout 42 and the spout cover 68 may be movably connected to the lid 11 such that each of the spout 42 and the spout cover 68 are movable (e.g., pivotally, rotationally, or the like, etc.) in opposite directions, as illustrated by arrow 200 associated with the spout 42 and arrow 202 associated with spout cover 68, between a stowed or non-use configuration (see FIG. 6) and a dispensing or use configuration (see FIGS. 1-3 and 5), where a user may access a liquid 300 within the container 10. Further additional details regarding the structure and functionality of the drink bottle 100 of the present disclosure are the same as in U.S. application Ser. No. 13/359,178, filed Jan. 26, 2012, titled DRINK BOTTLE ("the '178 application"), which will not be duplicated herein for the sake of brevity but which is hereby incorporated herein by reference as if set forth in its entirety herein, except for any differences described in the present disclosure.

Figure 2:
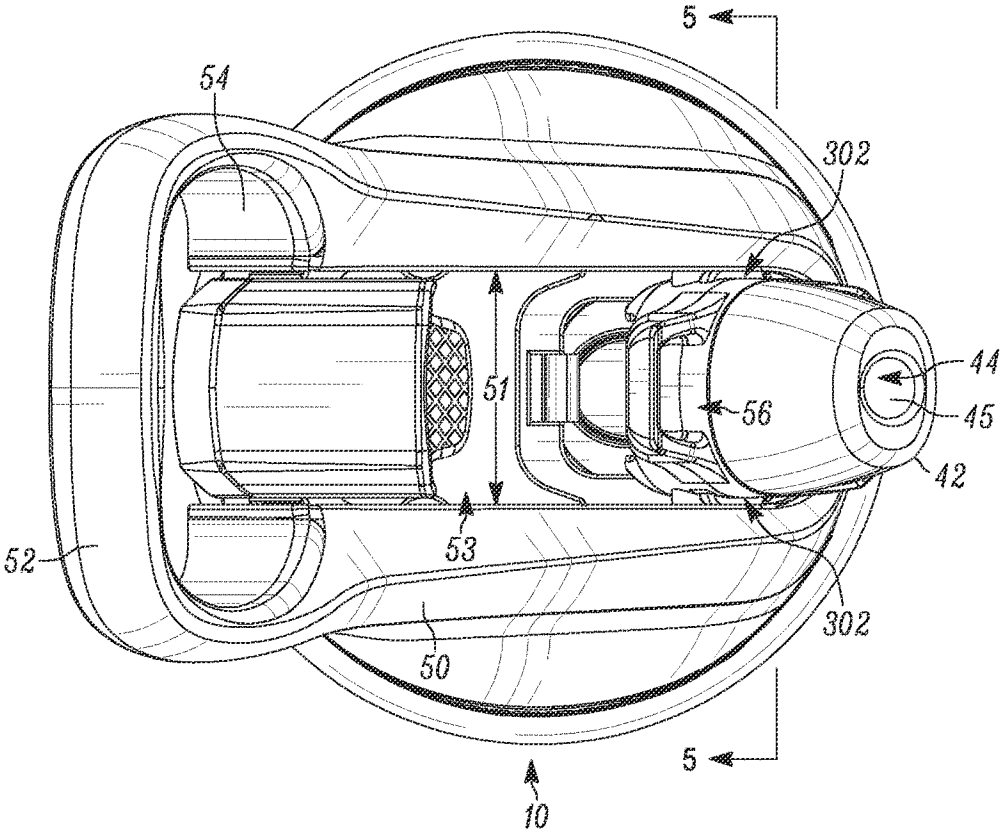
FIG. 2 is a top plan view of the drink bottle of FIG. 1.
Figure 3:
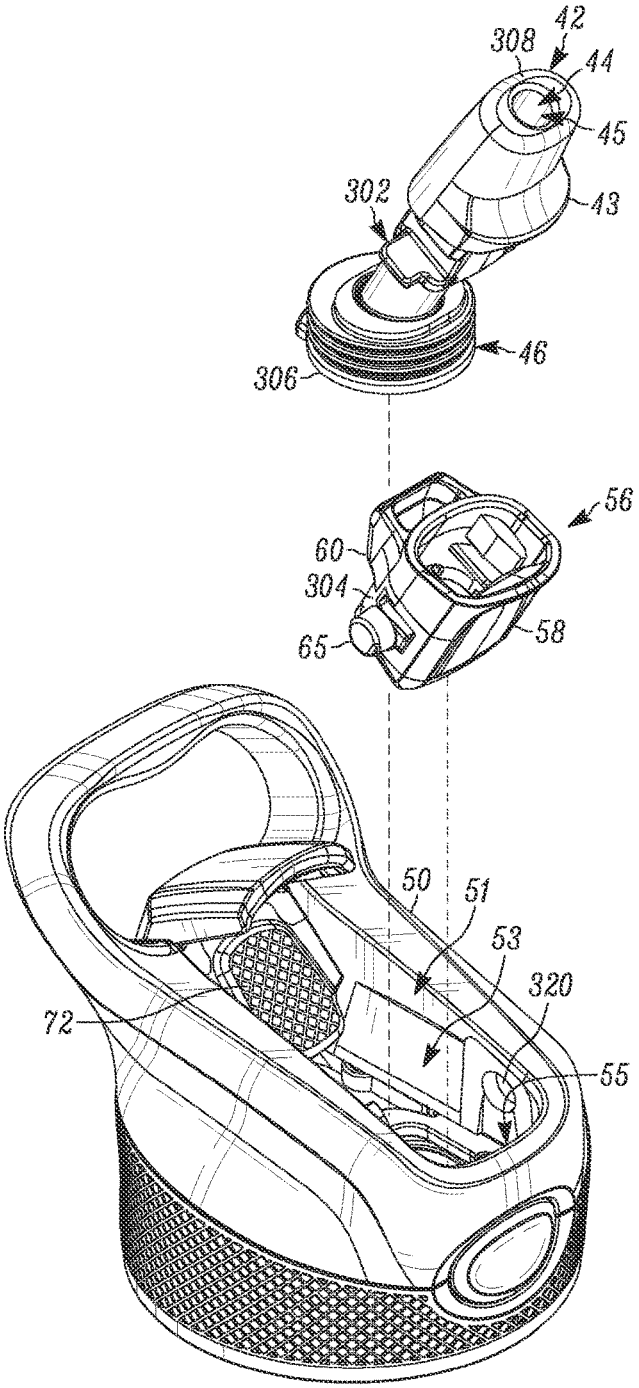
FIG. 3 is an exploded view of a lid of the drink bottle of FIG. 1.
Figure 4:
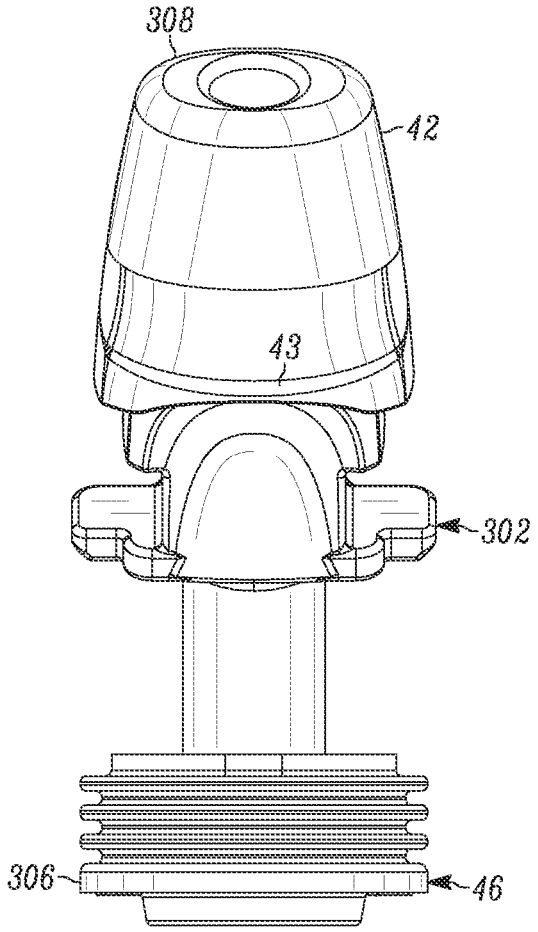
FIG. 4 is a front elevation view of a spout of the lid of the drink bottle of FIG. 1.
Figure 5:
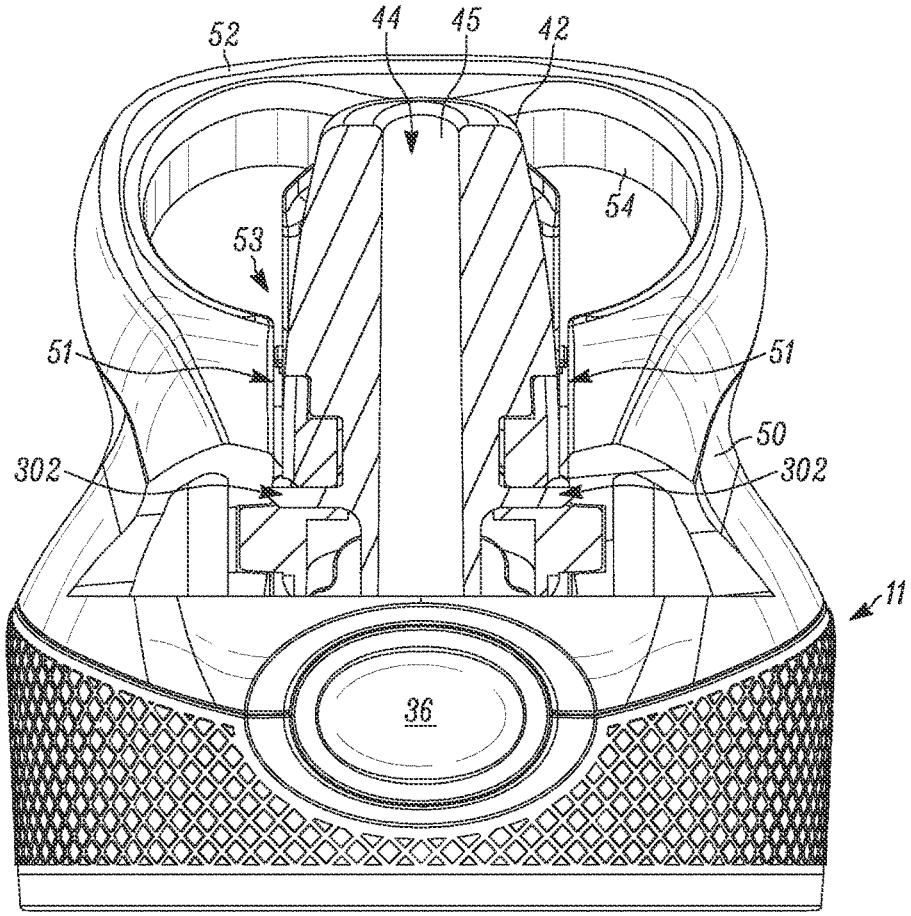
FIG. 5 is a cross-sectional view of the lid of the drink bottle of FIG. 1 in a dispensing configuration.

As shown in FIGS. 1, 2 and 3, the lid 11 includes a housing 50 that may include a handle 52 that may have an over-molded grip portion 54 and an open-top channel 53 that is defined in the lid 11 by interior sidewalls 51. The channel 53 may be substantially U-shaped (as viewed in FIG. 2 with an open end to the left on the drawing page), rectangular, square, oval, or the like, etc. in order to provide the desired functionality. In one embodiment, an end portion 55 of the sidewall 51 may be defined as the short side of the U-shaped channel 53. Preferably, the spout 42 and the spout cover 68 are disposed within the channel 53 such that when the spout 42 is oriented in the dispensing configuration (see FIGS. 1 and 2), the spout 42 is generally disposed adjacent to the end portion 55. It is within the teachings of the present disclosure that neither the spout 42 nor the collar 56 need to contact the end portion 55 for the spout 42 to be disposed in the dispensing configuration, but rather merely that a liquid 300 may be dispensed from the spout 42.

As shown in FIGS. 2-6, the spout 42 may include a passageway 44 defined by an interior wall 45 and a mounting portion 46 disposed at a proximate end 306 opposite the dispensing end 308. It is within the teaching of the present disclosure that the spout 42 may be formed of any suitable material, such as, but not limited to, silicone, rubber, synthetic, natural or any other suitable materials, or the like, etc. In one embodiment, the mounting portion 46 may include an enlarged portion having an outside diameter configured to sealingly secure the spout 42 to the lid 11 and prevent the leakage of liquid from within the container 10, and an inner diameter configured to engage a straw 48 that is useful for drawing the liquid from a lower portion of the container 10, as will be recognized by one of ordinary skill in the art. The passageway 44 may extend from a proximate portion adjacent the straw 48 to a distal portion near the tip or dispensing end 308 of the spout 42 so as to communicate therethrough with the straw 48 to provide a continuous unrestricted conduit for the liquid 300 within the container 10 to be withdrawn by a user without the activation of any valve or dispensing limiting mechanism, when the spout 42 is disposed in the dispensing or use configuration. Preferably, in one embodiment, the spout 42 is freely movable in the dispensing configuration such that only the end portion 55 of the channel 53 contacts the collar 56 to define a maximum open position, and only the flap contacts the spout 42 to define a minimum open position. Free, unrestricted movement of the spout 42 in the dispensing configuration is advantageous to the user as there is zero restriction in the straw 48 or spout 42 for extracting liquid from within the container 10. In one embodiment, the spout 42 may include a projection 302 that frictionally engages the sidewall 51 so that when the spout 42 moves between the stowed configuration and the dispensing configuration a rate of movement of the spout 42 is desirably controlled. It is within the teachings of the present disclosure that the projection 302 may have any suitable structural configuration in order to provide the desired functionality. For example, in one embodiment, the projection 302 may be configured as an arm extending laterally with respect to a longitudinal axis 310 (see FIGS. 5 and 6) of the passageway 44 defined by the interior wall 45 of the spout 42. One of skill in the art will recognize that the projection 302 may generally be any portion of the spout 42, regardless of shape, construction or formation that engages, contacts or is contiguous with the sidewall 51 when the spout 42 is moved between the stowed and dispensing configurations. Preferably, configured as such in one embodiment, the projection 302 may extend normal to a plane of rotation defined by a longitudinal axis 310 of the spout 42 when moved between the stowed configuration and the dispensing configuration. The rate of movement of the spout 42 may be controlled by adjusting the frictional engagement between the projection 302 and the sidewall 51, or in other words, by adjustment of various factors or variables, such as, for example only, the coefficient of friction of each of the materials, load imparted by the projection 302 on the sidewall 51, taper of the sidewall 51 in the direction of the end portion 55, or the like, etc. In one embodiment, the spout 42 rate of movement is less than a rate of movement of the spout cover 68 when the spout 42 and the spout cover 68 are moved between the stowed configuration and the dispensing configuration. This embodiment is advantageous because the disadvantages of the prior art are avoided without unnecessary complication or reduction of functionality. In one embodiment where the spout 42 includes a projection 302 that frictionally engages the sidewall 51 as the spout moves between the stowed and dispensing configurations, rate of movement of the spout 42 is controlled such that a liquid 300 disposed within the spout 42 when the spout 42 is disposed in the stowed configuration is not discharged from the spout 42 when the spout 42 is moved from the stowed configuration to the dispensing configuration. Again, this embodiment is advantageous such that the user has a pleasing experience when using the drink bottle.

As shown in FIGS. 2, 3, 5 and 6, the collar 56 may include a cover portion 58 that is snap-fit connected to the catch portion 60 to surround the spout 42. Preferably, the collar 56 is movably connected to the housing 50 in any suitable manner, such as by an axle 65 that extends from the collar 56 to engage the aperture or blind bore 320 defined in the sidewall 51. It is within the teachings of the present disclosure that the cover portion 58 and catch portion 60 are preferably disposed closely proximate and most preferably in contact with an exterior surface of the spout 42. In one embodiment, the cover portion 58 extends from a position adjacent the proximal end of the spout near the mounting portion 46 to an intermediate protrusion 43 of the spout 42 in order to provide a protective cover for the lower portion of the spout 42 when disposed in the stowed configuration (see FIG. 6). Preferably, the spout 42 may be configured to include shoulders on opposite sides that generally correspond to the cover portion 58 and the catch portion 60 of the collar 56 in order to engage the upper distal ends of the collar 56 so that the collar 56, when moved in the direction of arrow 76, will stretch and crimp the passageway 44, rather than permitting the spout 42 to withdraw with respect to the collar 56. In one embodiment, the collar 56 may be connected about the spout 42 such that the projection 302 extends through an opening 304 defined in the collar 56. In another embodiment, the projection 302 may be disposed above the collar 56, such as a portion of the shoulder or a further extension thereof, as desired to provide the intended functionality.

In one embodiment, further a biasing element may be disposed to impart a biasing force on the spout 42 in the direction of the dispensing configuration when the spout 42 is disposed in the stowed configuration. Similar to the spring element associated with the spout cover 68, and in fact, in some embodiments, the spring element may be the biasing element of the present disclosure. For example, the biasing element may include a first end contiguous with the spout 42 and a second end contiguous with the lid 11, such as, for example, a torsion, leaf, or the like, etc. spring. For example, similar as shown in the '178 application, a torsion spring may be disposed about the pivot axle 65 of the collar 56 such that a first end contacts the collar 56 or spout 42 and the second end contacts the lid 11, or the deformable flap 72 of the spout cover 68 may impart the biasing force on the spout 42 as a result of its resiliency and bending in the stowed configuration. In another embodiment, the spout 42 when disposed in the stowed or nonuse configuration, the spout 42 is sealed against liquid 300 discharge from the container 10 because the proximate portion of the passageway 44 is stretched, kinked, crimped or bent back on itself much like closing a valve and thereby sealed such that there is no communication between the passageway 44 and the straw 48. As a result of such stretching and crimping of the spout 42 when the spout 42 is moved from the dispensing configuration to the stowed configuration, a biasing force is generated and applied to the spout 42 when secured in the stowed configuration by the actuation assembly. After activation of the actuation assembly, the biasing force is applied to the spout 42 to move the spout 42 from the stowed configuration to the dispensing configuration. The disadvantages of the prior art described herein may be overcome because during movement of the spout from the stowed configuration to the dispensing configuration the projection 302 frictional engagement with the sidewall 51 dissipates the biasing force and controls the rate of movement of the spout 42. In one embodiment, all of the biasing force is dissipated by the projection 302 frictional engagement so that the spout 42 does not contact an end portion 55 of the sidewall 51 in the dispensing configuration.

The preceding detailed description merely sets forth some examples and embodiments of the present disclosure and that numerous changes to the disclosed embodiments can be made in accordance with the disclosure herein without departing from its spirit or scope. The preceding description, therefore, is not meant to limit the scope of the disclosure but to provide sufficient disclosure to one of ordinary skill in the art to practice the invention without undue burden.

The invention claimed is:

1. A drink bottle, comprising:

a container;

a lid connected to the container, the lid including a lid housing;

a spout coupled to the lid housing and movable between a stowed configuration and a dispensing configuration, the spout defining a passageway in fluid communication with an interior of the container when disposed in the dispensing configuration; and an actuator assembly movably connected to the lid housing, the actuator assembly comprising a release button and a latch operatively coupled to the release button and movably disposed within the lid housing between a first position, in which the latch is operatively coupled to the spout when the spout is disposed in the stowed configuration to retain the spout in the stowed configuration, and a second position, in which the latch is operatively uncoupled from the spout, such that the spout moves from the stowed configuration to the dispensing configuration, and wherein the latch moves from the first position to the second position responsive to actuation of the release button.

2. The drink bottle of claim 1, wherein the spout moves toward the release button when moving from the stowed configuration to the dispensing configuration.

3. The drink bottle of claim 1, further comprising a collar coupled to the spout, the collar comprising a catch portion and a cover portion coupled to the catch portion.

4. The drink bottle of claim 3, wherein the cover portion is seated against the lid housing when the spout is in the dispensing configuration, and wherein the cover portion is spaced from the lid housing when the spout is in the stowed configuration.

5. The drink bottle of claim 3, wherein the latch engages the catch portion when the spout is disposed in the stowed configuration to retain the spout in the stowed configuration, and wherein the latch is disengaged from the catch portion when the spout is disposed in the dispensing configuration.

6. The drink bottle of claim 4, wherein the spout moves from the stowed configuration to the dispensing configuration when the latch is disengaged from the catch portion of the spout responsive to actuation of the release button.

7. The drink bottle of claim 6, wherein the latch comprises a hook, the hook being arranged within an opening of the catch portion when the spout is disposed in the stowed configuration to retain the spout in the stowed configuration, and wherein the spout moves from the stowed configuration to the dispensing configuration when the hook is removed from the opening responsive to the actuation of the release button.

8. A lid configured for connection to a drink bottle, the lid comprising:

a lid housing;

a spout coupled to the lid housing and movable between a stowed configuration and a dispensing configuration, the spout defining a passageway in fluid communication with an interior of the drink bottle when disposed in the dispensing configuration; and an actuator assembly movably connected to the lid housing, the actuator assembly comprising a release button and a latch operatively coupled to the release button and movably disposed within the lid housing between a first position, in which the latch is operatively coupled to the spout when the spout is disposed in the stowed configuration to retain the spout in the stowed configuration, and a second position, in which the latch is operatively uncoupled from the spout, such that the spout moves from the stowed configuration to the dispensing configuration, and wherein the latch moves from the first position to the second position responsive to actuation of the release button.

9. The lid of claim 8, wherein the spout moves toward the release button when moving from the stowed configuration to the dispensing configuration.

10. The lid of claim 8, further comprising a collar coupled to the spout, the collar comprising a catch portion and a cover portion coupled to the catch portion.

11. The lid of claim 10, wherein the cover portion is seated against the lid housing when the spout is in the dispensing configuration, and wherein the cover portion is spaced from the lid housing when the spout is in the stowed configuration.

12. The lid of claim 11, wherein the latch engages the catch portion when the spout is disposed in the stowed configuration to retain the spout in the stowed configuration, and wherein the latch is disengaged from the catch portion when the spout is disposed in the dispensing configuration.

13. The lid of claim 12, wherein the spout moves from the stowed configuration to the dispensing configuration when the latch is disengaged from the catch portion of the spout responsive to actuation of the release button.

14. The lid of claim 13, wherein the latch comprises a hook, the hook being arranged within an opening of the catch portion when the spout is disposed in the stowed configuration to retain the spout in the stowed configuration, and wherein the spout moves from the stowed configuration to the dispensing configuration when the hook is removed from the opening responsive to the actuation of the release button.

15. The lid of claim 8, further comprising a biasing element disposed to impart a biasing force on the spout in the direction of the dispensing configuration when the spout is disposed in the stowed configuration and wherein the biasing force is dissipated during movement of the spout from the stowed configuration to the dispensing configuration.

16. The drink bottle of claim 1, further comprising a biasing element disposed in the lid housing and configured to bias the latch to the first position.

17. The drink bottle of claim 1, further comprising a biasing element disposed adjacent the release button and configured to bias the release button away from the lid housing.

18. The lid of claim 8, further comprising a biasing element disposed in the lid housing and configured to bias the latch to the first position.

19. The lid of claim 8, further comprising a biasing element disposed adjacent the release button and configured to bias the release button away from the lid housing.

* * * * *